United States Patent [19]

Harrison

[11] Patent Number: 4,734,212

[45] Date of Patent: Mar. 29, 1988

[54] LUBRICATING OIL COMPOSITIONS CONTAINING BIS-MANNICH BASE DEPOSIT INHIBITORS AND A PROCESS FOR THEIR PREPARATION

[75] Inventor: James J. Harrison, Novato, Calif.

[73] Assignee: Chevron Research Company, San Francisco, Calif.

[21] Appl. No.: 846,768

[22] Filed: Mar. 31, 1986

[51] Int. Cl.[4] ..... C10M 129/26; C10M 133/04

[52] U.S. Cl. ..... 252/51.5 R; 252/33.6; 252/34; 252/35; 252/38; 252/54.6; 252/56 R

[58] Field of Search ..... 252/42.1, 51.5 R, 51.5 A, 252/34, 40.7, 56 R; 562/448

[56] References Cited

U.S. PATENT DOCUMENTS

| | | | |
|---|---|---|---|
| 2,624,757 | 11/1950 | Bersworth | 260/518 |
| 2,794,818 | 6/1957 | Bersworth | 260/438 |
| 2,967,196 | 1/1961 | Kroll et al. | 71/1 |
| 3,459,661 | 8/1969 | Schlobohm | 252/52 R |
| 3,632,637 | 1/1972 | Martell | 260/519 |
| 3,758,540 | 9/1973 | Martell | 260/439 |
| 4,069,249 | 1/1978 | Gaudette et al. | 562/448 |
| 4,225,502 | 9/1980 | Gaudette et al. | 562/448 |
| 4,338,460 | 7/1982 | Gaudette et al. | 562/448 |

OTHER PUBLICATIONS

Canadian Journal of Chemistry, vol. 64 (1986), pp. 449–456.

*Primary Examiner*—William R. Dixon, Jr.
*Assistant Examiner*—Ellen McAvoy
*Attorney, Agent, or Firm*—S. R. La Paglia; R. C. Gaffney; L. S. Squires

[57] ABSTRACT

Disclosed are Bis-Mannich base deposit inhibitors; lubricating oil compositions containing these inhibitors and a process for preparing these inhibitors.

7 Claims, No Drawings

LUBRICATING OIL COMPOSITIONS CONTAINING BIS-MANNICH BASE DEPOSIT INHIBITORS AND A PROCESS FOR THEIR PREPARATION

BACKGROUND OF THE INVENTION

1. Field of the Invention

The present invention is directed toward lubricating oil compositions containing Bis-Mannich base inhibitors, and to a process for their preparation. The Bis-Mannich base inhibitors employed in the lubricating oil compositions of this invention are represented by the Formula I:

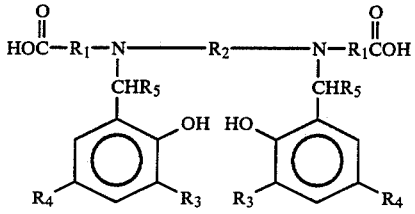

I wherein $R_1$ is independently alkylene of from 1 to 4 carbon atoms; $R_2$ is alkylene of from 2 to 6 carbon atoms; $R_3$ and $R_4$ are independently hydrocarbyl of from 1 to 30 carbon atoms with the proviso that the sum of all $R_3$ and $R_4$ hydrocarbyl carbon atoms is sufficient to render the compounds of Formula I oil soluble; $R_5$ is independently selected from the group consisting of hydrogen, alkyl of from 1 to 6 carbon atoms, phenyl and phenyl substituted with 1 to 2 substituents selected from hydroxy and alkyl of from 1 to 6 carbon atoms; and salts thereof.

2. Prior Art

Oils suitable for lubricating internal combustion engines are generally either mineral oils or synthetic oils of lubricating viscosity. In either case, during engine operation, these oils are subject to degradation resulting in harmful deposits and varnish formation in the engine. In order to prevent deposit and varnish formation, the present invention is directed to lubricating oil compositions containing deposit inhibitors. In particular, the present invention is directed toward lubricating oil compositions containing a new class of deposit inhibitors which are Bis-Mannich base inhibitors represented by Formula, I above.

U.S. Pat. No. 2,967,196 discloses certain ethylene diamine diacetic acids containing phenolic groups useful for chelating polyvalent metal ions in neutral and alkaline aqueous solutions.

U.S. Pat. Nos. 3,632,637 and 3,758,540 disclose iron chelates of N-(2-hydroxybenzyl)-substituted amino polycarboxylic acids. These compounds are disclosed as a source of iron for plants growing in alkaline soils.

U.S. Pat. Nos. 2,624,757 and 2,794,818 disclose halo substituted aralkyl alkylene diamine diacetic acids and salts thereof useful as bactericidal and fungicidal agents.

However, none of these references discloses lubricating oil compositions containing the Bis-Mannich bases of this invention nor does any of these references suggest that these Bis-Mannich bases would possess deposit inhibiting properties.

SUMMARY OF THE INVENTION

In its composition aspect, the instant invention is directed toward a lubricating oil composition comprising an oil of lubricating viscosity and a deposit inhibiting effective amount of a compound of the Formula I:

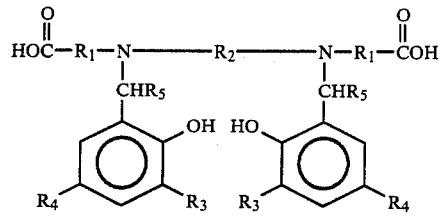

I wherein $R_1$ is independently alkylene of from 1 to 4 carbon atoms; $R_2$ is alkylene of from 2 to 6 carbon atoms; $R_3$ and $R_4$ are independently hydrocarbyl of from 1 to 30 carbon atoms with the proviso that the sum of all $R_3$ and $R_4$ hydrocarbyl carbon atoms is sufficient to render the compound of formula I oil-soluble; $R_5$ is independently selected from the group consisting of hydrogen, alkyl of from 1 to 6 carbon atoms, phenyl and phenyl substituted with 1 to 2 substituents selected from hydroxy and alkyl of from 1 to 6 carbon atoms; and salts thereof.

Suitable salts include salts such as potassium, sodium, magnesium, barium, calcium, zinc and the like.

In preferred embodiments, $R_1$ is preferably a straight-chain alkylene group of from 1 to 4 carbon atoms; more preferably $R_1$ is a straight-chain alkylene group of from 1 to 2 carbon atoms; and most preferably $R_1$ is methylene, i.e., $—CH_2—$.

$R_2$ is preferably a straight-chain alkylene group of from 2 to 6 carbon atoms; more preferably $R_2$ is a straight-chain alkylene group of from 2 to 3 carbon atoms; and most preferably $R_2$ is ethylene, i.e., $—CH_2CH_2—$.

$R_3$ and $R_4$ are independently hydrocarbyl of from 1 to 30 carbon atoms with the proviso that the sum of all $R_3$ and $R_4$ hydrocarbyl carbon atoms is sufficient to render the compound oil soluble. If the sum of all $R_3$ and $R_4$ hydrocarbyl carbon atoms is at least 10 carbon atoms and preferably at least 18 carbon atoms, the compounds are generally believed to be oil soluble.

$R_3$ and $R_4$ can be the same or different alkyl groups of from 1 to 30 carbon atoms. $R_3$ and/or $R_4$ alkyl groups can be a single alkyl group or a mixture of alkyl groups. For instance, a $C_{15}$ to $C_{20}$ alkyl $R_3$ group can be prepared by employing a $C_{15}$ to $C_{20}$ olefin mixture and alkylating the appropriate phenol.

$R_5$ is preferably hydrogen or alkyl of from 1 to 6 carbon atoms and most preferably is hydrogen.

In a process aspect, the instant invention is directed toward a method for preparing a Bis-Mannich base of the formula:

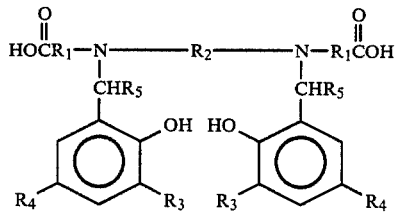

wherein $R_1$ is alkylene of from 1 to 4 carbon atoms; $R_2$ is alkylene of from 2 to 6 carbon atoms; $R_3$ and $R_4$ are independently hydrocarbyl of from 1 to 30 carbon atoms; $R_5$ is selected from the group consisting of hydrogen, alkyl of from 1 to 6 carbon atoms, phenyl and phenyl substituted with 1 to 2 substituents selected from hydroxy and alkyl of from 1 to 6 carbon atoms; and salts thereof; which comprises the steps of (1) combining in a suitable inert diluent from about 2 equivalents to about 6 equivalents of a substituted phenol of the formula

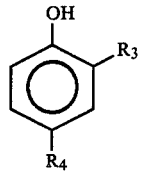

wherein $R_3$ and $R_4$ are as defined above; with essentially one equivalent of a diamine diacid of the formula $$HO\overset{O}{\overset{\|}{C}}R_1-NH-R_2-NH-R_1\overset{O}{\overset{\|}{C}}OH$$

wherein $R_1$ and $R_2$ are as defined above; or the salts thereof;

(2) adjusting the pH of the mixture produced in (1) above to between about pH 7 to about pH 9;

(3) combining to the mixture of (2) above at a temperature sufficient to cause reaction from about 2 equivalents to about six equivalents of formaldehyde per equivalent of diamine diacid while maintaining the pH from about 7 to 9.

This process aspect of the instant invention is based on the discovery that by adding the formaldehyde to a mixture of the phenol and diamine diacid in an inert diluent maintained at a pH of between about 7 to 9, substantially theoretical yields of the Bis-Mannich base is obtained.

In preferred embodiments, approximately two-fold excess of formaldehyde and phenol to the diamine diacid results in the best yield.

Preferably, the pH is maintained at a pH of between 7.5 and 8.5 and most preferably the pH is maintained at or near pH 8.

The Bis-Mannich bases produced by the process of this invention are excellent metal ion chelators, especially for iron. Accordingly, these Bis-Mannich bases are useful for forming iron chelates which in turn are useful as a source of iron for plants growing in an alkaline soil environment. See, for instance, U.S. Pat. Nos. 3,632,637 and 3,758,540 which are incorporated herein by reference. It is also contemplated that the compounds produced by the compounds of the instant invention are useful in treating iron overload diseases in a patient in need of such treatment. Also, as noted above, Bis-Mannich bases of Formula I containing sufficient $R_3$ and $R_4$ hydrocarbyl carbon atoms so as to be oil-soluble are useful as deposit inhibitors in lubricating oil compositions.

Alkylene, as used in describing the $R_1$ and $R_2$ groups, denotes both straight- and branched-chain saturated alkylene groups, i.e., 1,3-propylene, ($-CH_2CH_2CH_2-$);

1,2-propylene ($-CH_2\underset{\underset{CH_3}{|}}{CH}-$)

and the like.

Hydrocarbyl, as used in describing the $R_3$ and $R_4$ groups denote an organic radical composed of carbon and hydrogen which may be aliphatic, alicyclic, aromatic or combinations thereof, e.g., aralkyl. Preferably, the hydrocarbyl group will be relatively free of aliphatic unsaturation, i.e., ethylenic and acetylenic, particularly acetylenic unsaturation.

Formaldehyde, as used herein, includes both formaldehyde and paraformaldehyde and substituted formaldehyde, i.e., $$R_5\overset{O}{\overset{\|}{C}}H.$$

DETAILED DESCRIPTION OF THE INVENTION

The process of the instant invention is generally conducted by combining into an inert diluent, a diamine diacid, II, and a substituted phenol, III. Preferably, the diluent is maintained at a pH of 8 and higher in order to solubilize the diamine diacid. Most preferably, the diluent is maintained at approximately pH 8. In any event, after combining the diamine diacid, II,and the substituted phenol, III, in the inert diluent, it is critical that the pH of this system be adjusted to between pH 7 to 9. Generally, this is accomplished by adding a metal hydroxide to the system, i.e., $M(OH)_m$ wherein M is a metal selected from sodium, potassium, magnesium, calcium barium, zinc and the like and m is equal to the valence of M. Under such conditions, the salt of the diacid is generated. This salt is represented by the Formula V, $$M_{1/m}O\overset{O}{\overset{\|}{C}}R_1NHR_2NHR_1\overset{O}{\overset{\|}{C}}OM_{1/m} \qquad V$$

wherein $R_1$, $R_2$, and m are as defined above.

To this mixture is added formaldehyde, IV, as shown in reaction (1) below:

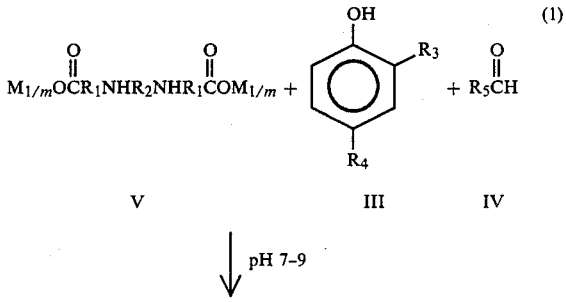

-continued

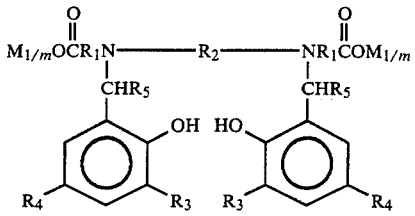

wherein $R_1$, $R_2$, $R_3$, $R_4$, $R_5$, M, and m are defined above.

In regard to reaction (1) above, the order of reactants II, III, and IV is critical. In particular, if the formaldehyde is added to the diamine diacid is prior to addition of the substituted phenol, a substantial amount of impurity is formed as shown in reaction (2) below:

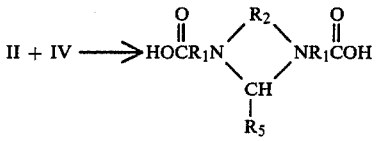

(2)

The impurity formed in reaction (2) is minimized in reaction (1) by adding the formaldehyde at a temperature sufficient to cause reaction after combining both the diamine diacid and the phenol.

Reaction (1) is conducted in an inert diluent which is generally any inert solvent in which the reactants are soluble. Preferred diluents are water, alkanol and a water/alkanol mixture. It is critical that the diluent employed is maintained between pH 7.0 and 9.0 which is generally accomplished by titrating the diluent with the necessary acid or base until the desired pH is reached. This pH range is critical because at pH's lower than 7.0 the diamine diacid, II, becomes insoluble and at pH's higher than 9.0, the impurity of reaction (2) increases. Preferably, reaction (1) is conducted at between pH 7.5 and 8.5 and most preferably at or near pH 8.0.

Reaction (1) is conducted at a temperature sufficient to cause reaction. In general, reaction (1) is conducted at from 30° C. to 200° C. although preferably at from 50° C. to 130° C. The reaction is generally complete from within 1 to 24 hours. The salts of the Bis-Mannich base product can be isolated by conventional techniques, i.e., filtration, chromatography (on silica gel or alumina), etc. The salts of the Bis-Mannich base products are further purified from the reaction mixture by titrating the diluent with an appropriate metal hydroxide, i.e., sodium hydroxide, potassium hydroxide, etc. to a pH of approximately 9–10.

The Bis-Mannich base diacid is prepared by titrating the diluent with an acid to approximately pH 5. In titrating with an acid, it is critical that the pH be maintained above 4 because below pH 4 product decomposition may occur.

Alternatively, the product of reaction (1) may be employed in a lubricating oil composition without further purification and/or isolation.

Dialkyl phenols, III, are known in the art and may be prepared by alkylating phenol or an alkyl substituted phenol, i.e., ortho or para cresol, 4-ethylphenol, etc., via methods known per se. If $R_3$ and $R_4$ are identical, the alkylation reaction is accomplished by employing two equivalents of the same olefin. If $R_3$ and $R_4$ are different, alkylation can be conducted on a substituted phenol such as cresol or can proceed in a two-step process wherein first one equivalent of an olefin is employed to alkylate phenol to form a monoalkyl olefin which is then alkylated with a second equivalent of a different olefin to form a dialkyl phenol. Addition of the first equivalent of olefin occurs generally at the para position of phenol although some amount of ortho substitution occurs. The second equivalent of olefin will generally add to the ortho position. Alternatively, the alkylation reaction can employ a mixture of the two olefins.

The alkylation reaction is conducted in the presence of an alkylating catalyst such as Amberlyst 15 ® available from Rohm and Haas, Philadelphia, Pennsylvania. The reaction is conducted at a temperature of from about 60° C. to about 200° C., and preferably 125° C. to 180° C. in an essentially inert solvent at atmospheric pressure. The reaction is generally complete in about 1 to 10 hours.

Diamine diacids, II, are known in the art, some of which are commercially available. These compounds are readily prepared by reacting a diamine, VI, with a haloalkyl carboxylic acid, VII, as shown in reaction (3) below:

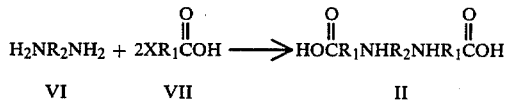

(3)

VI VII II wherein $R_1$ and $R_2$ are as defined above and X is a halogen selected from chloro and bromo. This reaction is known in the art. Formaldehyde, paraformaldehyde and

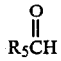

are known in the art and are generally commercially available.

The Bis-Mannich base inhibitors of this invention are useful as deposit inhibitors when employed in lubricating oils. When employed in this manner, the additive is usually present in from 0.01 to 15 percent by weight to the total composition and preferably at about 0.5 to 10 percent by weight and most preferably 1–5 percent by weight. The lubricating oil used with the additive compositions of this invention may be mineral oil or synthetic oils of lubricating viscosity and preferably suitable for use in the crankcase of an internal combustion engine. Crankcase lubricating oils ordinarily have a viscosity of about 1300 CSt 0° F. to 22.7 CSt at 210° F. (99° C.). The lubricating oils may be derived from synthetic or natural sources. Mineral oil for use as the base oil in this invention includes paraffinic, naphthenic and other oils that are ordinarily used in lubricating oil compositions. synthetic oils include both hydrocarbon synthetic oils and synthetic esters. Useful synthetic hydrocarbon oils include liquid polymers of alpha olefins having the proper viscosity. Especially useful are the hydrogenated liquid oligomers of $C_6$ to $C_{12}$ alpha olefins such as 1-decene trimer. Likewise, alkyl benzenes of proper viscosity such as didodecyl benzene, can be used. Useful synthetic esters include the esters of both monocarboxylic acid and polycarboxylic acids as well as monohydroxy alkanols and polyols. Typical examples are didodecyl adipate, pentaerthritol tetracapoate, di-2-ethylhexyl adipate, dilaurylsebacate and the like. Complex esters prepared from mixtures of mono and dicarboxylic acid and mono and dihydroxy alkanols can also be used.

Blends of hydrocarbon oils with synthetic oils are also useful. For example, blends of 10 to 25 weight percent hydrogenated 1-decene trimer with 75 to 90 weight percent 150 SUS (100° F.) mineral oil gives an excellent lubricating oil base.

Additive concentrates are also included within the scope of this invention. The concentrates of this invention usually include from about 85 to 50 weight percent of an oil of lubricating viscosity and from about 15 to 50 weight percent of the inhibitor of this invention. Typically, the concentrates contain sufficient diluent to make them easy to handle during shipping and storage. Suitable diluents for the concentrates include any inert diluent, preferably an oil of lubricating viscosity, so that the concentrate may be readily mixed with lubricating oils to prepare lubricating oil compositions. Suitable lubricating oils which can be used as diluents typically have viscosities in the range from about 35 to about 500 Saybolt Universal Seconds (SUS) at 100° F. (38° C.), although an oil of lubricating viscosity may be used.

Other additives which may be present in the formulation include rust inhibitors, foam inhibitors, corrosion inhibitors, pour point depressants, antioxidants, and a variety of other well-known additives.

The following examples are offered to specifically illustrate this invention. These examples and illustrations are not to be construed in any way as limiting the scope of this invention.

EXAMPLES

EXAMPLE 1

Preparation of

Disodium Salt of N,N'-di(3,5-dimethyl-2-hydroxybenzyl)ethylene-diamine-N,N'-diacetic acid To a three-neck, 100-ml flask, equipped with a nitrogen source, thermometer, magnetic stirrer, heating mantle, SCM electrode +reference electrode, and dropping funnel was added 7 ml, 30% NaOH solution and 15 ml methanol. To this was added 4.4 g (0.025 mol) ethylene-diamine-N,N'-diacetic acid and 12.2 g of 2,4-dimethylphenol (0.10 mol) dissolved in 12 ml methanol. The pH initially at 10.9 was adjusted by the addition of 10% HCl to pH 8.2. The reaction was heated to reflux and to this was added dropwise with stirring 8.2 g 37% formaldehyde solution (0.10 mol) in 24 ml methanol. The pH of the mixture was controlled at pH 8.0. This was heated at reflux for a total of 5 hours, then the mixture was cooled to room temperature. The pH was adjusted in an NaOH solution to 9.0 and a product precipitated. This was filtered and dried in a vacuum oven at 70° overnight. A total of 8.08 g of product 7a as disodium salt was recovered; mp 181°–183° C.; 62% yield; Anal. Calcd. for $C_{24}H_{30}N_2O_6Na_2$[19] $2H_2O$: C, 54.96; H, 6.54; N, 5.34; Na, 8.77. Found: C, 54.54; H, 6.26; N, 5.35; Na, 8.45; $^1H$ NMR δ ($CD_3OD$) 6.8 (brs, 2H, ArH), 6.5 (brs, 2H, ArH), 3.6 (S, 4H, $HO_2CCH_2N$), 3.1 (s, 4H, $ArCH_2N$), 2.6 (s, 4H, $NCH_2CH_2$), 2.20 (s, 6H, $ArCH_3$), 2.15 (s, 6H, $ArCH_3$).

In a manner similar to the procedure outlined in Example 1 above, the following compounds were prepared:

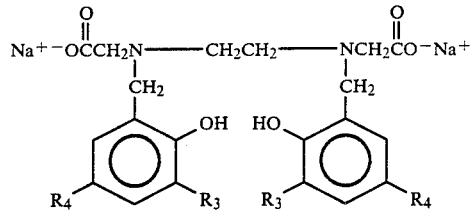

| | $R_3$ | $R_4$ |
|---|---|---|
| Example 2 | t-butyl | $CH_3$ |
| Example 3 | t-butyl | t-butyl |
| Example 4 | $-CH_3$ | $-C_8H_{17}$ |
| Example 5 | $-CH_3$ | $-C_{12}H_{25}$ |
| Example 6 | $-CH_3$ | $C_{18}H_{37}$ to $C_{24}H_{49}$ (prepared from a $C_{18}$–$C_{24}$ mixed olefin fraction)[1] |

[1]The process for preparing this compound is sensitive to water. In particular, excess water results in a two-phase reaction mixture. Accordingly, paraformaldehyde was employed in this example to minimize water content.

EXAMPLE 7

The lubricating oil compositions of this invention were demonstrated as deposit inhibitors by a panel coker bench test. See U.S. Pat. No. 3,966,807 which is incorporated herein for its teaching of the panel coker bench test. The panel coker test is a controlled test for measuring deposit formation in formulated oils. The apparatus consists of an oil container or sump with a multipronged spinner controlled by a motor for splashing sample oil onto a hot plate. The plates used in the panel coker test are panels of aluminum pre-cleaned and weighed. The test consists of adding the test oil to the sump and placing the plate into the plate holder. The plate is heated and the test oil at 180° C. to 300° C. is splashed against the heated plate intermittently. After test completion, the plate is removed, washed with hexane and then dried. The dried plate is weighed and the difference between its after test weight and before test weight is taken as the deposit weight.

The lubricating oil employed in this test is Cit-Con 350N which contains 4% of a monosuccinimide, 36 millimoles of a calcium overbased phenate, 18 millimoles of a zinc dithiophosphate; and 1% of the product of the example indicated in Table I. To lubricating oil composition is added 0.2 ml of an oxidation catalyst per 200 g of lubricating oil composition. Said oxidation catalyst is prepared by adding 62.12 g of copper napthenate solution (7.88% copper) to 48.04 g iron naphthenate (6.12% iron) and siluting to 200 ml with pearl oil.

The result of the panel coker test are given in Table I below.

TABLE I

Panel Coker Test Results

| Lubricating Oil Composition Containing 1% of Example | Weight of Deposit (in Milligrams) |
|---|---|
| Reference | 68.5 |
| 2 | 183.5 |
| 3 | 24.8 |
| 4 | 25.3 |
| 5 | 2.2 |
| 6 | 7.6 |

These results indicate that lubricating oil compositions of Examples 3–6 are effective in inhibiting deposits.

What is claimed is:

1. A lubricating oil composition comprising an oil of lubricating viscosity and a lubricating oil degradation deposit inhibiting effective amount of a compound of the Formula I:

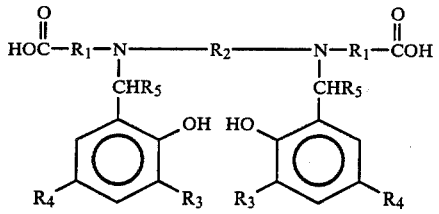

I wherein $R_1$ is independently alkylene of from 1 to 4 carbon atoms; $R_2$ is alkylene of from 2 to 6 carbon atoms; $R_3$ and $R_4$ are independently hydrocarbyl of from 1 to 30 carbon atoms with the proviso that the sum of all $R_3$ and $R_4$ hydrocarbyl carbon atoms is sufficient to render the compound of formula I oil-soluble; $R_5$ is independently selected from the group consisting of hydrogen, alkyl of from 1 to 6 carbon atoms, phenyl and phenyl substituted with 1 to 2 substituents selected from hydroxy and alkyl of from 1 to 6 carbon atoms; and salts thereof.

2. The lubricating oil composition of claim 1 wherein $R_1$ is a straight-chain alkylene group of from 1 to 4 carbon atoms.

3. The lubricating oil composition of claim 2 wherein $R_1$ is methylene.

4. The lubricating oil composition of claim 1 wherein $R_2$ is a straight-chain alkylene group of from 2 to 6 carbon atoms.

5. The lubricating oil composition of claim 4 wherein $R_2$ is ethylene.

6. The lubricating oil composition of claim 1 wherein $R_1$ is methylene, $R_2$ is ethylene and $R_5$ is hydrogen.

7. A lubricating oil concentrate comprising from about 85 to 50 percent of an oil of lubricating viscosity and from about 15 to 50 percent of a compound of the Formula I:

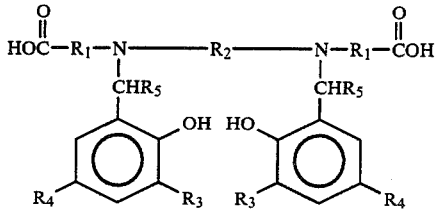

I wherein $R_1$ is independently alkylene of from 1 to 4 carbon atoms; $R_2$ is alkylene of from 2 to 6 carbon atoms; $R_3$ and $R_4$ are independently hydrocarbyl of from 1 to 30 carbon atoms with the proviso that the sum of all $R_3$ and $R_4$ hydrocarbyl carbon atoms is sufficient to render the compound of formula I oil-soluble; $R_5$ is independently selected from the group consisting of hydrogen, alkyl of from 1 to 6 carbon atoms, phenyl and phenyl substituted with 1 to 2 substituents selected from hydroxy and alkyl of from 1 to 6 carbon atoms; and salts thereof.

* * * * *